US007946878B2

(12) United States Patent
Lang et al.

(10) Patent No.: US 7,946,878 B2
(45) Date of Patent: May 24, 2011

(54) INSULATION DISPLACEMENT CONNECTION APPARATUS, AND METHOD FOR CONNECTING TWO COMPONENTS USING THE SAME

(75) Inventors: Christian Lang, Aichach (DE); Daniel Huber, Reutlingen (DE); Achim Silberbauer, Reutlingen (DE); Jochen Kircher, Reutlingen (DE); Adolf Dillmann, Meunsingen (DE)

(73) Assignee: Robert Bosch GmbH, Stuttgart (DE)

( * ) Notice: Subject to any disclaimer, the term of this patent is extended or adjusted under 35 U.S.C. 154(b) by 147 days.

(21) Appl. No.: 12/374,366

(22) PCT Filed: Oct. 24, 2007

(86) PCT No.: PCT/EP2007/061409

§ 371 (c)(1),
(2), (4) Date: Jan. 19, 2009

(87) PCT Pub. No.: WO2008/055786

PCT Pub. Date: May 15, 2008

(65) Prior Publication Data

US 2010/0285686 A1 Nov. 11, 2010

(30) Foreign Application Priority Data

Nov. 6, 2006 (DE) ..... 10 2006 052 119

(51) Int. Cl.
*H01R 4/24* (2006.01)

(52) U.S. Cl. ..... 439/404

(58) Field of Classification Search ..... 439/395, 439/404, 78–83, 860, 873, 876, 883, 888
See application file for complete search history.

(56) References Cited

U.S. PATENT DOCUMENTS

| | | | | |
|---|---|---|---|---|
| 5,122,066 | A * | 6/1992 | Plossmer | 439/78 |
| 5,178,558 | A * | 1/1993 | Knox et al. | 439/404 |
| 5,269,700 | A * | 12/1993 | Mitra | 439/395 |
| 5,314,350 | A * | 5/1994 | Matthews et al. | 439/404 |
| 6,045,392 | A * | 4/2000 | Daoud | 439/409 |
| 2001/0022050 | A1 | 9/2001 | Bentz et al. | |

FOREIGN PATENT DOCUMENTS

| | | |
|---|---|---|
| DE | 101 29 840 | 1/2003 |
| DE | 202 12 273 | 7/2003 |
| DE | 102 49 683 | 5/2004 |
| EP | 0 472 006 | 2/1992 |
| EP | 1 206 008 | 5/2002 |
| WO | WO 2005/088774 | 9/2005 |

* cited by examiner

*Primary Examiner* — Chandrika Prasad
(74) *Attorney, Agent, or Firm* — Merchant & Gould P.C.

(57) ABSTRACT

The invention relates to an insulation displacement connection and to a method for connecting two components, especially for high current applications, said connection comprising a first insulation displacement element, which is fixed to a first component, and a second insulation displacement element, which is fixed to a second component. The two insulation displacement elements can be inserted into each other in the direction of assembly, the first and/or second insulation displacement element being fixed to the first and/or second component in such a way that the insulation displacement element is moveably arranged in a plane transversal to the direction of assembly.

16 Claims, 6 Drawing Sheets

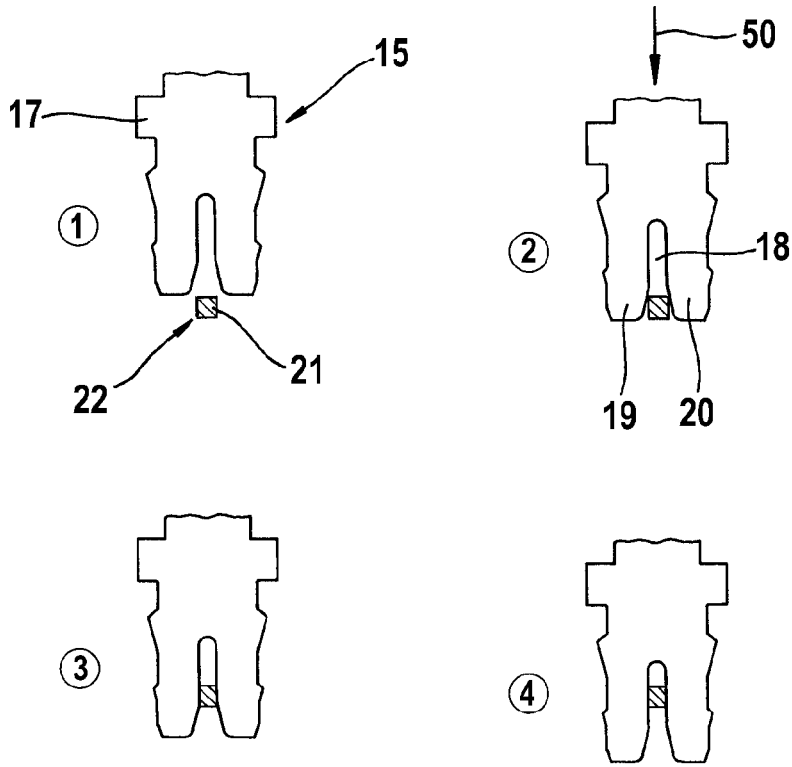
FIG. 7
FIG. 8
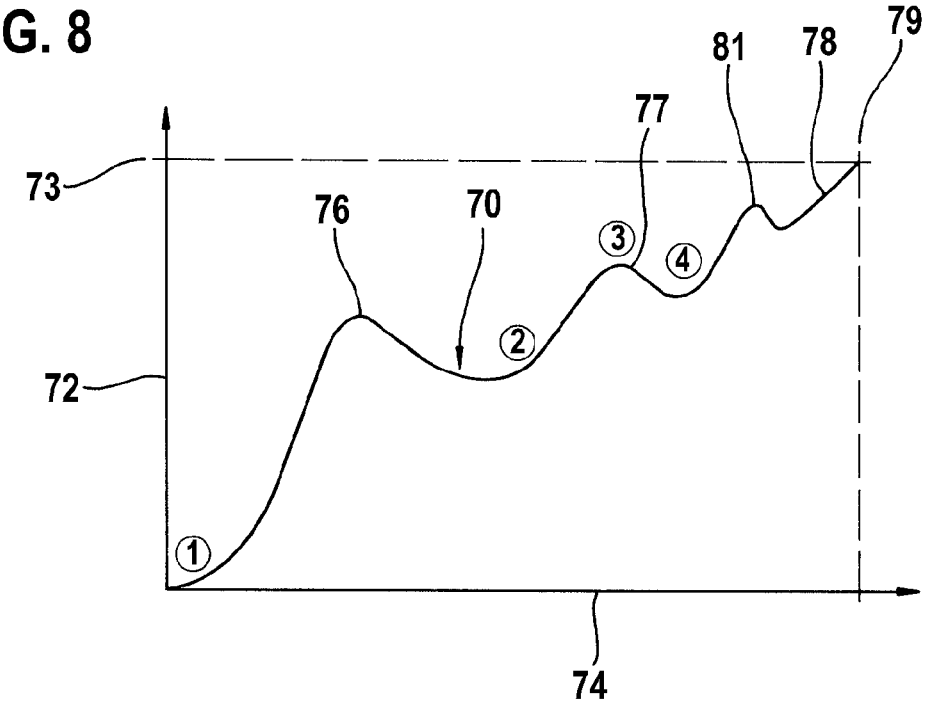

FIG. 9
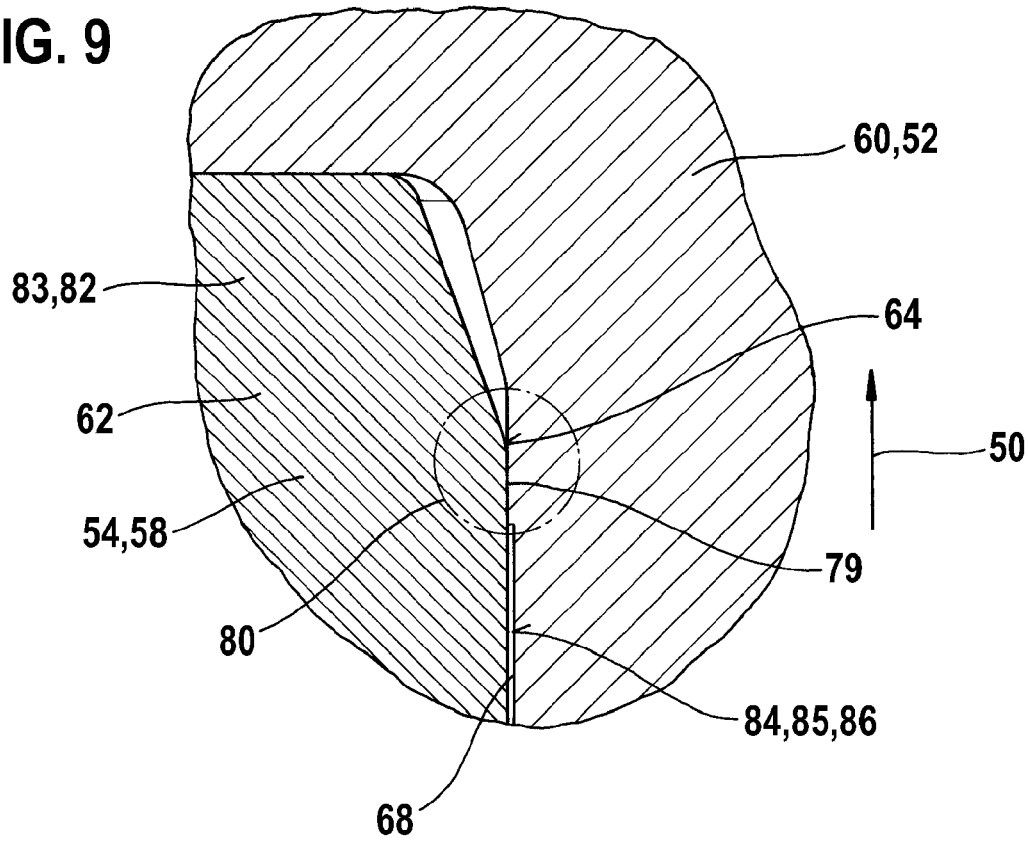
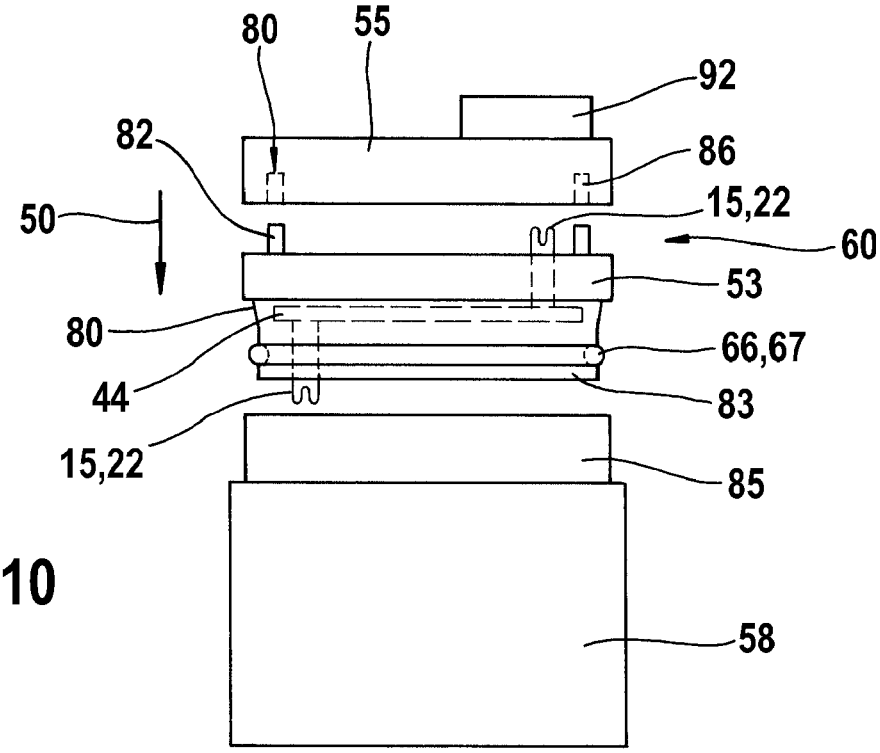
FIG. 10

INSULATION DISPLACEMENT CONNECTION APPARATUS, AND METHOD FOR CONNECTING TWO COMPONENTS USING THE SAME

TECHNICAL FIELD

The invention is based on an insulation displacement connector and a method for connecting two components according to the category of the independent claims.

BACKGROUND

An electronic module is known from US 2001/0022050 A1, which can be inserted into the electromotor of a power window. For the electrical connection from the plug connection to the collector of the electromotor forklike motor current plugs are arranged at the electronic module, which can be intervened by tonguelike plug pins of the electromotor. In order for the motor pins to be inserted easier into the forklike plugs, the latter provide a thinning, due to which the forklike plugs can be tilted from the assembly direction into a certain area. But this has the disadvantage that the plug pin can easily tilt when inserting it into the forklike plug, since both plug elements are not anymore arranged along a common straight line along the direction of insertion.

SUMMARY

In contrast the insulation displacement connector and the method for connecting two components according to the invention with the characteristics of the independent claims have the advantage, that at least one insulation displacement element is moveably arranged in a plane transversal to the direction of insertion. Thereby the second insulation displacement element can be positioned when inserting the first insulation displacement element in such a way that both insulation displacement elements are arranged exactly on a straight line along the assembly direction. Due to relocating the one insulation displacement element transversal to the direction of assembly a tilting of the two insulation displacement elements to each other is prevented, whereby a reliable electrical high current connection is ensured despite the moveable arrangement. Such a insulation displacement connection 37 creates a strain relief, which protects the fixture of the insulation displacement elements at the components reliably even at high temperature variations and long operational life spans Due to the measures that are listed in the dependent claims advantageous improvements and configurations of the characteristics in the independent claims are possible. It is extremely advantageous thereby to fix at least one insulation displacement element at the corresponding component by a bend area, so that even in the moveable area, with which the insulation displacement element is connected to the component, a reliable electrical current conduction is ensured due to the area of the electrical conductor that is accomplished with the insulation displacement element in one piece.

Due to one of the invention's improvements, at which a connection is arranged as a flat strip connection, which provides an insulation displacement connection element and at least one support shoulder for the intake of an assembly power in its free end when connecting with a counter element, a high-current loadable, simple connection path is created. The high-current connection goes from the substrate, with which it is preferably directly connected, over the insulation displacement connection element to a counter element that is connected with the latter by assembly power, whereby the described connection path is arranged as a flat strip connection that is in one piece, so that there is only one juncture with the insulation displacement connection element. In order to connect the insulation displacement connection element with a corresponding counter element, an assembly power has to be established, which is retained by at least one support shoulder, so that no improper powers are introduced into the substrate at the mechanical connection. Therefore a very low-impedance connection exists, which is moreover high-current loadable and which can be handled easily and without problems.

It is further provided that the flat strip connection is arranged as a metal strip, in particular a sheet metal stamping. Such a metal strip is high-current capable and can be very easily manufactured in one piece especially as a sheet metal stamping.

It is furthermore advantageous to provide two support shoulders that are opposed to each other. The flat strip connection is supported at the two support shoulders when assembling with the counter element, whereby high assembly powers can be established problem-free without having improper power transfers.

It is furthermore advantageous when the direct connection of the insulation displacement elements at the components, for example the substrate, is established as soldered-, welded- and/or rivet joint.

One improvement of the invention provides that the flat strip connection is deformable in the direction of its longitudinal dimension by creating at least one bending point. Therefore a certain deformability exists when assembling with the counter element, so that tolerances can be adjusted. The bending point is preferably established as U-web. That means that the flat strip connection proceeds to the bending point, there it goes over from its longitudinal dimension into the U-form of the U-web and thence back to the original longitudinal dimension direction. The U-web provides basically a square profile, so that a good deformability exists, which is not given with regard to the usually preferred rectangular, especially long-rectangular profile of the flat strip connection.

It is furthermore advantageous when the insulation displacement connection element is established as an insertion slot for an insertion web of the counter element or as an insertion web for an insertion slot of the counter element.

The invention further concerns a power electronic device with a power electronic circuit, especially as previously described, whereby a counter flat strip connected is provided that is electrically connected with the flat strip connection by assembly. This counter flat strip connection is preferably established as counter element or provides it.

It is furthermore provided that the counter flat strip connection is arranged as a metal strip, in particular a sheet metal stamping. Therefore the basic construction of flat strip connection and counter flat strip connection is very similar. Different are only the connection elements in order to assemble the parts. These connection elements have to be arranged correspondingly to each other, in order to create an electrically stable connection by assembly, in particular by connecting. It is preferably provided that this electrical connection is established as a connection that is undetachable after the assembly. The undetachability results from a corresponding material deformation that takes place during assembly.

Moreover it is provided that at least one of the components provides an electrical non-conducting bearing channel, in which the flat strip connection is put in such a way that it is supported with its at least one support shoulder, preferably with both support shoulders, at the channel edges. Therefore the flat strip connection can be moved in the longitudinal direction of the channel, but transversally supported to it, so that the counter element can be added to the electrical connecting with a corresponding assembly power.

Preferably it is provided that after finishing the assembly of flat strip connection and counter flat strip connection a hermetical closing takes place, so that then no optical control is possible anymore. The hermetical closing can for example take place by positioning into a housing, by infusing and/or overmolding with an electrically non-conducting material.

The assembly process has the advantage that the correct creating of the insulation displacement connection and the mechanical assembly connection can be monitored by measuring the assembly force course, even when the insulation displacement connections are invisible. By adjusting a maximum assembly power the assembly process can be terminated in a defined manner, so that a reliable connection is always ensured by the same power closure.

BRIEF DESCRIPTION OF THE DRAWINGS

The drawings demonstrate the invention with the aid of an embodiment. Namely it shows:

FIG. 7 is schematically the assembly process of the two insulation displacement elements;

FIG. 8 is a measured force course during assembly of two components;

FIG. 9 is an explosion illustration of the components that have to be connected; and FIG. 10 is a section of a press fit of the two components on average.

DETAILED DESCRIPTION

Figure 1:
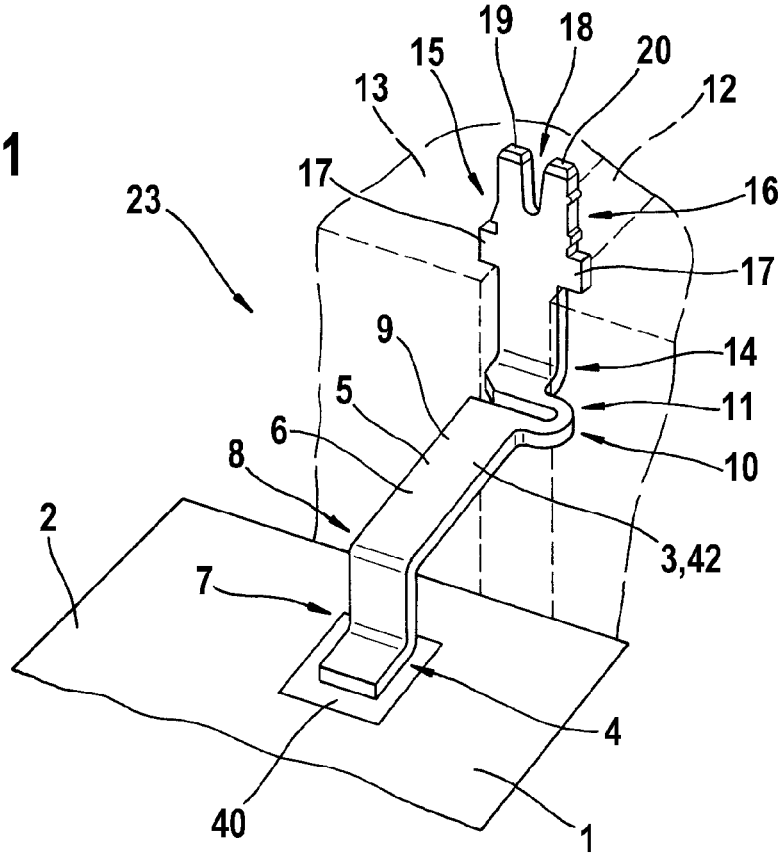
FIG. 1 is a power electronic circuit, which is provided with an insulation displacement element.

FIG. 1 shows a substrate 1 that is arranged as a circuit board 2. A power electronic is located on the circuit board 2, which is not shown for convenience. An electrical, high-current loadable connection 3 is attached to the circuit board 2, thus to a contact area 40, which is connected with the power electronic, whereby the connector 4 can be arranged as soldered-, welded- and/or rivet joint. The connector 4 is arranged as direct connector 4, which means the connection 3 is directly connected with the mentioned contact area 40.

The connection 3 is arranged as flat strip connection 5. It consists of an electrically conducting metal strip 6, which basically provides a rectangular profile. The one end area 7 is provided with a bend 8. A linear area 9, which merges into a bending area 10, joins the bend 8. The bending area 10 overtops the metal strip sideways and provides a square profile. Viewed from the broadside of the area 9 the bending point 10 is arranged as U-web 11. In a not shown embodiment a meander-formed element can be provided instead of the U-web.

After the bending point 10 the metal strip 6 goes back to its rectangular flat strip profile and sinks into a bearing channel 12, which is arranged in a support element 13 made from electrically non-conducting material. The end area 7 is bend upwards within the bearing channel 12 in the direction of insertion 50 (bending 14) and runs to a first insulation displacement element 15, which is outside of the bearing channel 12. The insulation displacement element 15 is arranged in the area of a free end 16 of the flat strip connection 5. Two support shoulders 17 of the flat strip connection 5 that are opposing each other and that are created in one piece with the metal piece 6 and that are supported at the channel edges of the bearing channel 12 are located there. The insulation displacement element 15 provides an insertion slot 18, which means that the flat strip connection 5 is build forklike with two fork teeth 19, 20 on the end side.

Figure 2:
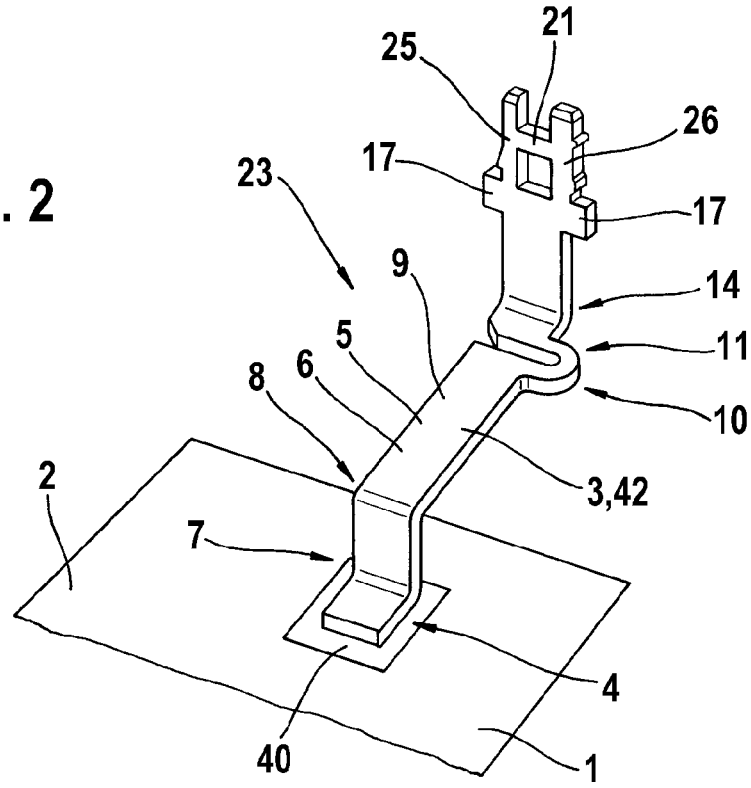
FIG. 2 is a component with an alternative insulation displacement element.

An identical formation is present at the embodiment of FIG. 2—opposed to FIG. 1—so that it can be referred to the previous description. The only difference is that at the first insulation displacement element 15 there is no insertion slot 18, but instead an insertion web 21. The insertion web 21 is connected at both ends with the remaining structure of the metal strip 6, which means one end if the insertion web 21 is connected in one piece with a first shank 25 of the first insulation displacement element 15 and the other end with a second shank 26.

Figure 3:
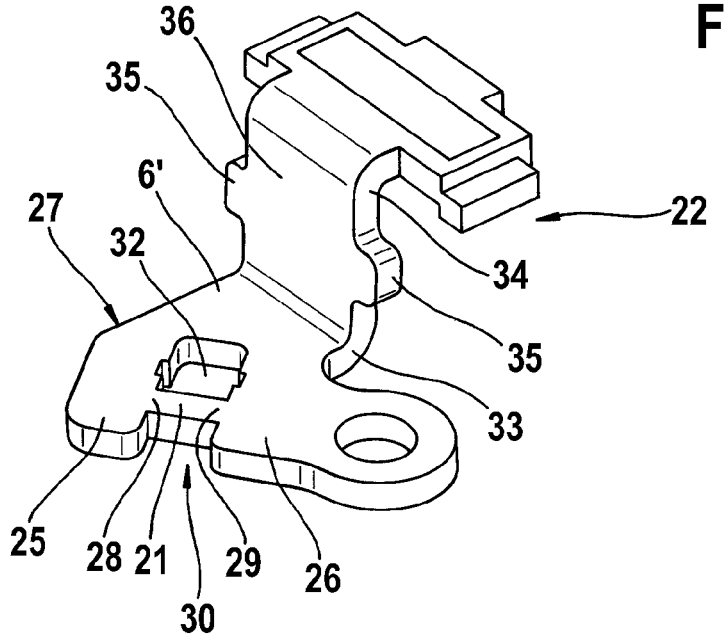
FIG. 3 is an insulation displacement element, which can be coupled with a corresponding insulation displacement element according to FIG. 1.

FIG. 3 shows a counter element as second insulation displacement element 22, which can be electrically connected with the high-current loadable connection 3 from FIG. 1 by connecting in the direction of assembly 50 in the course of an assembly process. In particular an undetachable assembling of the two components takes place. Even the second insulation displacement element 22 is high-current loadable. Altogether an insulation displacement connection 37 is created. The second insulation displacement element 22 for example belongs to an electrical consumer, in particular an electromotor 58, whereby this consumer/electromotor 58 shall be electrically connected with the power electronic circuit 23 that is indicated in FIGS. 1 and 2, which means that the power electronic on the substrate 1 supplies the corresponding electrical consumer over the flat strip connection 5 and the second the second insulation displacement element 22.

According to FIG. 3 the second insulation displacement element 22 provides an insertion web 21. The insertion web 21 is arranged between the two shanks 25 and 26 of the second insulation displacement element 22, in particular realized in one piece at the counter element 22. The two ends 28 and 29 of the insertion web 21 are connected in one piece with the shanks 25 and 26. Because the insertion web 21 bridges over an open edge recess, an open recess 30 and an opening 32 radially adjoining it. The second insulation displacement element 22 provides for example the bend course from FIG. 3 with two turns 33 and 34 and support webs 35. The electrical consumer, for example an electromotor 58 is electrically connected with the counter element 22, preferably directly, so that a low-impedance, high-current loadable connection is created.

The second insulation displacement element 22 is just like the flat strip connection 5 made of metal strip 6, in particular sheet metal stamping. The second insulation displacement element 22 represents a counter flat strip connection 36 for assembling with the flat strip connection 5. For assembling the counter flat strip connection 36 is pressed between the fork teeth 19 and 20 of the flat strip connection 5 with its insertion web 21, so that the insertion web 21 enters into the insertion slot 18, whereby an assembly process takes place and the high-current loadable connection is created. In particular it is provided that during the assembly process a force-displacement curve 70 of the assembly process is recorded. The insertion web 21 is hereby partially inserted into the insertion slot 18, whereby the end position is not yet reached. By increasing the force a dynamic friction appears, so that the assembly power 72 falls down. After that the assembly power 72 increases again to the end position. In this phase a first insulation displacement connection 37 is created with a significant impact peak. After its drop a second correspondingly equal connection is created also with a significant impact peak as long as a multipolar connection of the connector of the consumer to the power electronic is required. Until mounting the force also increases here continuously. Thus it can be determined with the mentioned power measurement whether all connections lie within the range of preset tolerances. If this is not the case, pieces could be missing, insulation displacement elements 15, 22 bend or contacts not created. Alternatively a press fit can be assembled in addition, which has to be visible at the recorded power measurement, in order to have control. The flat strip connection 5 is supported during the assembly process with its support shoulders 17 on the lateral sides of the bearing channel 12—as it can be seen in FIG. 1—so that no harmful forces are introduced into the substrate 1. Because of the bearing channel 12 a relocation of the direction of the flat strip connection 5 transversal to the direction of assembly 50 is possible in longitudinal direction of the bearing channel 12 by a compression or a widening of the bending point 10.

Figure 4:
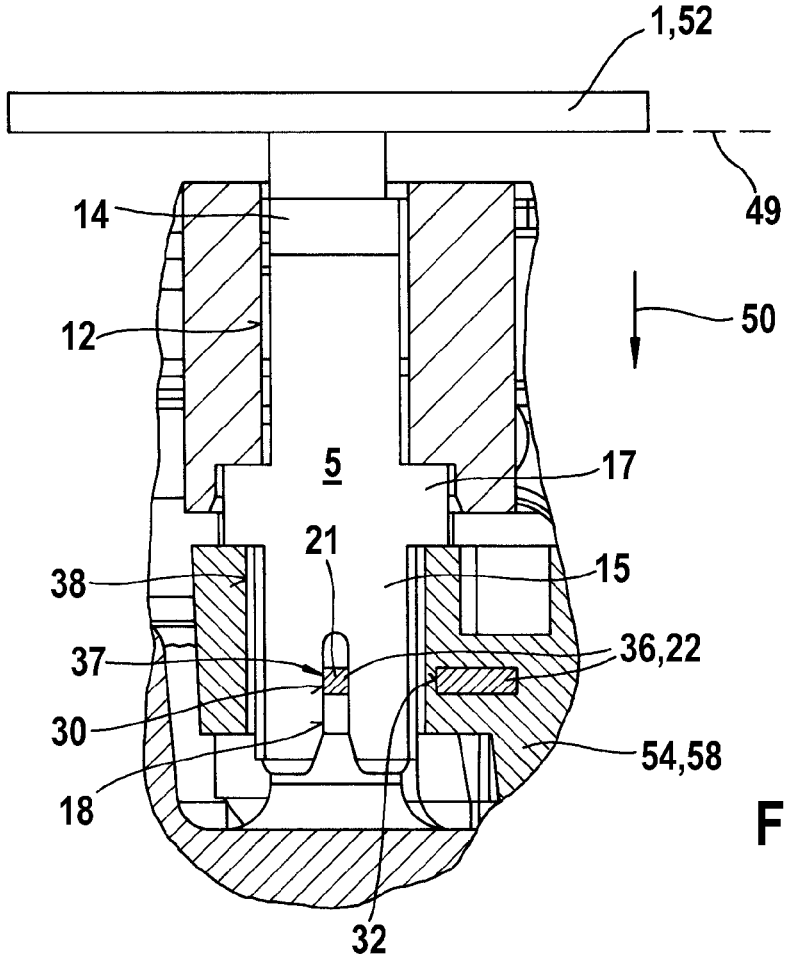
FIG. 4 is an insulation displacement element, which is coupled with an insulation displacement element that is arranged as a counter element.

FIG. 4 shows a flat strip connection 5 with an insertion slot 18, whereby the flat strip connection 5 is connected with the first component 52, which for example provides the power electronic. The flat strip connection 5 is connected with a counter flat strip connection 36, whereby it provides the insertion web 21, which is pressed into the insertion slot 18, so that an insulation displacement connection 37 has been created. The counter flat strip connection 36 is directly connected with a second component 54, for example an electrical consumer 58. The insertion web 21 is arranged immovably in a pocket 38 of the second component 54, for example injected in plastic. The two fork teeth 19, 20 of the first insulation displacement element 15 engage thereby in the recesses 30, 32 of the second insulation displacement element 22. The first insulation displacement element 15 is movably arranged by the bending point 10 transversal to the direction of assembly 50 in certain limits in the bearing channel 12 of the first component 52. During insertion the support shoulders 17 abut at the bearing channel 12, whereby the support shoulders 17 also abut with corresponding contact surfaces at the pocket 38 of the second component 54 after the insertion.

Figure 5:
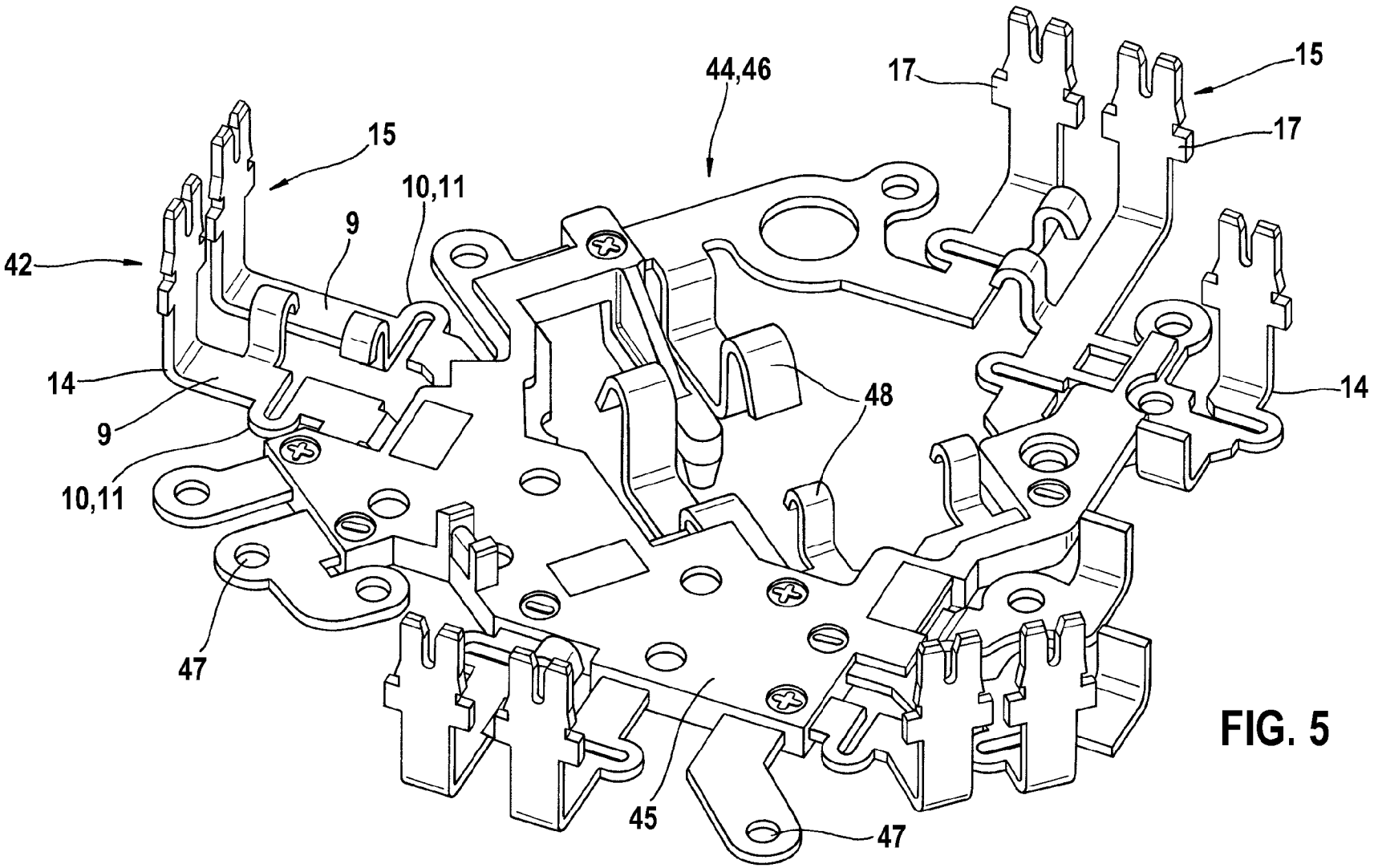
FIG. 5 is an electrical carrier plate with insulation displacement elements that are arranged at it.

FIG. 5 shows an electrical carrier plate 44, which is for example arranged as a punch grid 46. Several electrically detached parts of the punch grid 46 are thereby for example overmolded with a plastic plate 45. Several first insulation displacement elements 15 are here arranged at the electrical carrier plate 44, which are angled by the bending point 14 approximately rectangular to the carrier plate 44. In the even areas 9, which are arranged in the plane 49 transversal to the direction of assembly 50, the bending points are again formed as U-web 11, which stick out of the even areas 9 of the metal strip 6. If for example the second insulation displacement element 22 is inserted according to FIG. 3 in the direction of assembly 50 into the first insulation displacement element 15, the latter can be relocated within the plane 49 of the carrier plate 44 due to the approximately rectangular bending 14. Thereby the directions of the first insulation displacement element 15 do not change along the assembly direction 50 for example, so that the second insulation displacement elements 22 do not tilt when inserting. During insertion the first insulation displacement elements 15 can absorb the insertion force 72 over the formed support shoulders 17, or directly over the angled area 9 of the metal strip 6, which is supported at the first component 52. For the connection of further electrical components connection elements 48 are formed at the punch grid 46, which allow an electrical and/or mechanical connection with these electrical components, as for example throttles or condensers. Such an electrical carrier plate 44 is for example arranged within an electronic housing 60, whereby the first component 52 is here arranged as the first housing 53 and the second component 54 as second housing 55. The carrier plate 44 provides attachments 47 for connecting with the first component 52, which for example can be hot-embossed with the plastic of the first housing 53. If the two components 52, 54 are here fitted into each other, an insulation displacement connection 37 is simultaneously created by the insulation displacement elements 15, 22.

Figure 6:
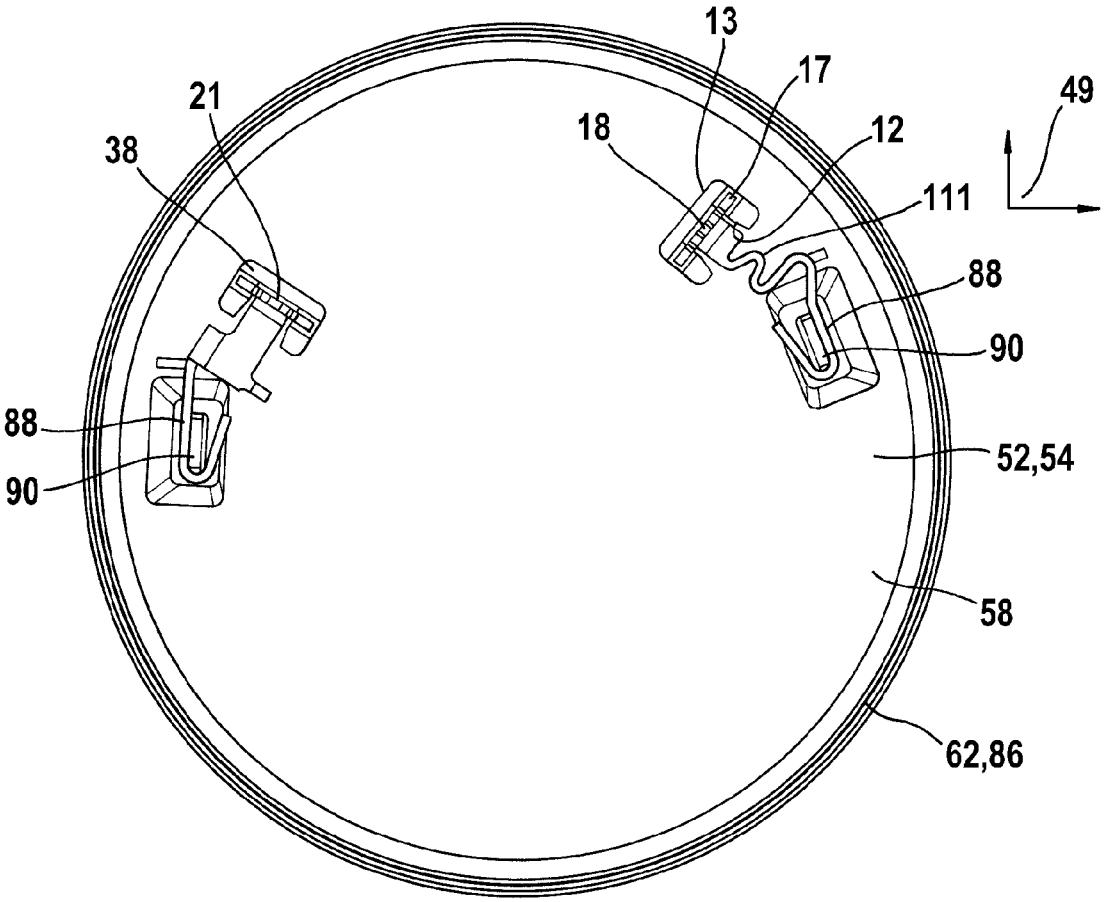
FIG. 6 is a plan view on an electromotor with insulation displacement elements that are arranged on it.

In an alternative embodiment according to FIG. 6 the second insulation displacement elements 22 are immovably arranged at a front wall 56 of the second component 54 that is established as an electromotor 58. The first insulation displacement elements 15 of the first component 52 that is established as electronic housing 60 can be inserted into these. The second insulation displacement elements 22 are electrically connected with connection tongues 90 of the electromotor 58 by claws 88 and mechanically stored pockets 38. Insertion webs 21 are formed at the second insulation displacement elements 22, in which for example the insertion slots 18 of the first insulation displacement elements of the carrier plate 44 according to FIG. 5 are inserted, which are moveably arranged transversal to the direction of assembly 50.

Alternatively the movable first insulation displacement elements 15 are arranged transversal to the direction of assembly 50 at the electromotor 58 and provide a meander-form web 11 as bending area 10. The first insulation displacement element 15 is thereby loosely stored in the bearing channel 12 and also electrically connected with the electromotor 58 over claws 88.

The first component 52 provides in FIG. 6 a shape 62 in the direction of assembly 50, which meshes in a corresponding matching 64 of the opposite component 54 during the assembly of the two components 52, 54. Thereby a seal 66 can be formed between the shape 62 and the matching 64, which seals the two components 52, 54 dust- and water-proof towards each other.

FIG. 7 shows four snapshots of the insertion process of the two insulation displacement elements 15, 22, whereby the insertion web 21 is inserted into the insertion slot 18 with the aid of the assembly power 72 along the assembly path 74 in the direction of assembly 50. The four snapshots are marked in FIG. 8 regarding a force course 70 of the first insulation displacement connection 37.

FIG. 8 shows a force course 70 of the assembly power 72 opposed to the assembly path 74 during connection of the electromotor 58 according to FIG. 6 with an electronic housing 60. The first local maximum 76 of the force course 70 corresponds with the deformation of the seal 66, which for example is arrange as O-ring 67, which is jammed between the two components 52, 54. After the deformation of the seal 66 the assembly power 72 decreases again, until it comes to a new power increase with another power maximum 77, which is produced by the assembly of the two insulation displacement elements 15, 22. Depending on the specific formation of the insulation displacement elements 15, 22 the assembly power 72 decreases again due to the dynamic friction between the two insulation displacement elements 15, 22, until it comes to a new power increase 78 at the end 79 of the assembly path 74, which is caused by creating a press fit 80 between the two components 52, 54. A further local power maximum 81 is caused by creating an insulation displacement connection 37 that is arranged sequentially offset to the direction of assembly 50. If such a force course 70 is measured when assembling the two components 52 and 54, it can be controlled with the aid of the measuring curve whether the insulation displacement connection 37 and the press fit 80 between the components 52 and 54 has been established properly. An erroneous connection, especially by snapping-off of an insulation displacement element 15, 22 or a damaging of the components 52, 54 or the seal 66 can be assumed at a measuring curve that deviates from the nominal course.

The formation of such a press fit 80 is for example shown in FIG. 9, at which the shape 62 of the first component 52 meshes into the recess 64 of the second component 54. It can be noticed thereby that the shape 62 creates a press fit 80 with the recess 64 not until the end 79 of the assembly path 74, which causes the power increase 78 when assembling the components 52 and 54. Over the first area of the assembly path 74 the shape 62 provides a clearance 68 towards the recess 64, due to which the two components 52, 54 are easily and reliably pre-centered against each other. The shape 62 can be arranged as stud 82, which meshes into a corresponding capsule 86 as recess. In a further embodiment, in which two housings 53 and 55 are fitted into each other, the shape 62 is arranged as surrounding wall 83 in the direction of assembly 50, which meshes into a corresponding recess 64 that is for example arranged as surrounding flute 84 or opposing surrounding wall 85.

Depending on the specific geometric formation of the insulation displacement elements 15, 22 a local power maximum 77 occurs when assembling the two insulation displacement elements 15, 22, as it is shown in FIG. 8, or it alternatively it comes to a constant power increase of the assembly power 72. If the force course 70 is measured during the assembly process, it can be compared to nominal curves in order to detect an error at the assembly process. In FIG. 8 the force course of the insulation displacement connection 37 provides the local power maximum 77, which results thereby that at the beginning of the assembly of the insertion web 21 into the insertion slot 18 (FIG. 7: picture 2) the assembly power 72 increases significantly due to the static friction and the deformation of the insulation displacement elements 15, 22 and afterwards proceeds to a slide process with a reduced dynamic friction (FIG. 7: picture 3), whereby the assembly power 72 decreases again.

FIG. 10 schematically shows again different components 52, 54, which can be connected with each other by an insulation displacement connection 37. On the one hand the housings 53 and 55 are for example connected to each other by the insulation displacement elements 15, 22, and on the other hand the assembled electronic housing 60 with the electromotor 58. The punch grid 46 is thereby arranged within the housing 55 in such a way that the insulation displacement elements 15 spread from the punch grid 46 upwards to the first housing 53 and downwards to the electromotor 58 and mesh into corresponding second insulation displacement elements 22 of these components. By the insulation displacement connection 37 simultaneously a mechanic connection of the individual components is created, which seals these in such a way that the insulation displacement elements 15, 22 cannot be seen anymore. A seal 66 is arranged between two components 52, 54, which is pressed together during assembly, which causes an increase of the assembly power 72. If the seal 66 is completely deformed, the assembly power 72 decreases again over the further assembly path 74. At the end 79 of the assembly path 74 a press fit 80 is established, which can be arranged between the surrounding walls 83, 85 of the components 52 and 54 or between a stud 82 and a corresponding capsule 86. Such insulation displacement connections 37 are especially suitable for feeding motor current over a connection plug 92, at which current of e.g. 50 to 150 ampere can flow.

In particular it is provided that an insulation displacement connection 37 according to the invention is established mechanically decoupled after the assembly process. This can for example take place if the high-current connections are not accessible anymore after the assembly process, because they are used in housing that have to be closed. In order to simplify the pressing of flat strip connections 5 and counter flat strip connections 36, a lubricant or sliding coating can be put on them. The insulation displacement connection 37 is preferably put into a pocket 38, which is closed during the assembly process. Thereby a flitter protection is ensured. In particular the first insulation displacement element 15 is arranged as moveable element due to the bending point 10, which can be connected with a solid, immovable second insulation displacement element 22 that is arranged as counter element. Alternatively it can also be proceeded in such a way that the second insulation displacement element 22 is movable and the first insulation displacement element 15 is arranged fixed. It shall be noted that with regard to the embodiments that are shown in the figures and description diverse combination possibilities among the individual characteristics are possible.

The invention claimed is:

1. An insulation displacement connection apparatus, comprising:

a first insulation displacement connection element fixed to a first component; and a second insulation displacement connection element fixed to a second component, wherein the first and second insulation displacement connection elements are insertable into each other in a direction of assembly for creating the insulation displacement connection apparatus, and wherein at least one of the first and second insulation displacement connection elements are fixed to the respective first and second component such as to enable the first insulation displacement connection element to be moveably arranged in a plane transversal to the direction of assembly.

2. The insulation displacement connection apparatus of claim 1, wherein at least one of the first and second insulation displacement connection elements is made from stamped sheet metal.

3. The insulation displacement connection apparatus of claim 1, wherein the first insulation displacement connection element provides a support shoulder for absorbing an assembly power when connecting with the second insulation displacement connection element that is arranged as a counter element, wherein at least two opposing support shoulders are provided.

4. The insulation displacement connection apparatus of claim 1, wherein the first or the second insulation displacement connection element is supported with at least one support shoulder by an electrically non-conducting bearing channel.

5. The insulation displacement connection apparatus of claim 1, wherein each of the first and second insulation displacement connection elements are deformable in a direction along a displacement element longitudinal dimension by forming at least one bending point.

6. The insulation displacement connection apparatus of claim 5, wherein the bending point is arranged as one of: a U-web; and a meander-formed element.

7. The insulation displacement connection apparatus of claim 1, wherein the first insulation displacement connection element provides for one of: an insertion slot for an insertion web of the second insulation displacement connection element; and an insertion web for an insertion slot of the second insulation displacement connection element.

8. The insulation displacement connection apparatus of claim 7, wherein the insertion web is connected in one piece at a first and a second end with a shank positioned on each of the first and second insulation displacement connection elements.

9. The insulation displacement connection apparatus of claim 1, wherein the first and second insulation displacement connection elements are fixed at an electrical carrier plate that is arranged within a closable housing, wherein the electrical carrier plate creates an insulation displacement connection within the closable housing.

10. The insulation displacement connection apparatus of claim 1, wherein the first and second insulation displacement connection elements are arranged between an electronic housing and an electromotor, and wherein simultaneously upon creation of the insulation displacement connection, a press fit between the electronic housing and the electromotor is established, especially a steering aid drive.

11. A method of connecting a first and second component, the method comprising:

fixing a first insulation displacement connection element to the first component;

fixing a second insulation displacement connection element to the second component, wherein the first and second insulation displacement connection elements are insertable into each other for creating an insulation displacement connection in a direction of assembly, and wherein upon said fixing, each of the first and second insulation displacement connection element is relocated and swiveled transversal to the direction of assembly upon inserting in a plane, wherein both the first and second insulation displacement connection elements are along the assembly direction.

12. The method of claim 11, further comprising measuring an assembly force during the assembly resulting in a force course used for detecting an erroneous creation of the connection.

13. The method of claim 12, further comprising determining upon an analysis of the force course a proper creation of an insulation displacement connection or a mechanical assembly connection, wherein the force course provides at least one or several local maximums.

14. The method of claim 13, further comprising comparing the force course of the assembly power to a set point curve of the force course, wherein an erroneous connection is detected at a corresponding deviation.

15. The method of claim 11, further comprising setting a maximum allowed assembly power during the connection of the components, wherein the maximum allowed assembly power is used as a cut-off criteria for an assembly path.

16. The method of claim 1, further comprising creating a press fit between each of the first and second components at the end of an assembly path.

* * * * *